United States Patent [19]

Roots

[11] Patent Number: 4,638,297

[45] Date of Patent: Jan. 20, 1987

[54] REMOTE SIGNALING BOX

[75] Inventor: Rolland R. Roots, St. Louis, Mo.

[73] Assignee: Killark Electric Manufacturing Company, St. Louis, Mo.

[21] Appl. No.: 642,442

[22] Filed: Aug. 20, 1984

[51] Int. Cl.[4] ..... G08B 25/00; H01H 27/10

[52] U.S. Cl. ..... 340/304; 340/287; 340/308; 200/43.01

[58] Field of Search ..... 340/287, 304, 308, 301, 340/545; 200/43.01, 161

[56] References Cited

U.S. PATENT DOCUMENTS

| | | | |
|---|---|---|---|
| 501,631 | 7/1893 | Smith . | |
| 542,074 | 7/1895 | Brombacher . | |
| 870,963 | 10/1907 | Holden . | |
| 1,616,879 | 2/1927 | Suren . | |
| 2,000,517 | 5/1935 | Horni | 177/372 |
| 2,210,512 | 8/1940 | Terjesen | 200/43.01 |
| 3,183,501 | 5/1965 | Seaton | 340/296 |
| 3,767,876 | 10/1973 | Batson | 200/161 |
| 4,017,844 | 4/1977 | Facchini et al. | 340/287 |
| 4,162,485 | 7/1979 | Facchini et al. | 340/289 |
| 4,280,120 | 7/1981 | Trafford | 340/303 |

*Primary Examiner*—Ulysses Weldon
*Assistant Examiner*—Ralph Smith
*Attorney, Agent, or Firm*—Rogers, Howell, Moore & Haferkamp

[57] ABSTRACT

A remote signaling box uses no glass or breakable parts. The signal box has an unbreakable door that protects a sliding panel and activator which constrains the internal alarm switch. When the door is closed, a foolproof interlock in the sliding panel prevents functioning of the switch. The sliding panel has an opening so that when it is pulled down a spring-loaded activator is released into the opening which allows the internally contained spring-loaded switch to function. No replacement parts are required after the box has been operated. A two-step operation is required for alarming to prevent inadvertent activation. The first step is to open the door which removes the foolproof interlock from the sliding panel. The second step is to pull down the sliding panel. The device is easily reset by moving the sliding panel to its original position and closing the door.

20 Claims, 7 Drawing Figures

REMOTE SIGNALING BOX

BACKGROUND AND SUMMARY

Applicant is aware of the following U.S. patents:

| Patent | Reg. No. |
|---|---|
| Electric Circuit Connection for Signaling or Telephone Boxes | 501,631 |
| Police Patrol Signal Box | 542,074 |
| Alarm Box Attachment | 870,963 |
| Signaling Mechanism | 1,616,879 |
| Door for Fire Alarm Boxes and the Like | 2,000,517 |
| Signal Station | 3,183,501 |
| Fire Protection Apparatus | 4,162,485 |
| Fire Alarm Signal Station | 4,280,120 |

The disclosures of the above patents are incorporated herein by reference.

This invention relates generally to remote signaling devices which permit an alarm to be initiated at various locations. Signaling boxes are well known in the art and are generally used so that a person who discovers an emergency, such as a fire, can promptly signal assistance.

One of the characteristics of these signaling boxes is a means to avoid inadvertent operation of the alarm. Some prior devices have used a sheet of single strength glass placed over the switch to prevent inadvertent operation. There are several difficulties with using these devices. First, a striking instrument, such as a hammer must be provided in order to break the glass. Even though the hammer is attached by a chain, it is very often missing or stolen. Second, the breakage of the glass is dangerous. Even though warnings are placed near these boxes, accidents may occur in which the glass shatters into the eyes of the person activating the alarm. Also, the switch cannot be reset into a non-alarm condition until the glass is replaced. Finally, the glass cover can be accidentally broken easily in high traffic, commercial or industrial areas.

Some devices have attempted to deal with the problem of breaking glass by substituting a glass rod on the inside of the box to prevent activation of the switch. This does not solve the problem of replacing the glass after the alarm has been activated. Further, broken glass must still be cleaned up and disposed of after activation of the alarm.

Signaling boxes which do not have glass generally limit access to the switch through use of a door cover. For example, one arrangement is to place a door cover directly over the switch or activator. The problem with this arrangement is that even though this will limit the access to the switch, the door cover does not prevent the activation of the switch. In another arrangement a glass rod (similar to that mentioned above) is used to prevent opening of the door cover. This arrangement retains the problem of broken glass disposal.

None of the above arrangements provide a quick method of returning the device to a normal condition. Most of the devices require replacement of a glass sheet, glass rod or the like. In certain applications, alarm conditions occur very frequently. For example, in chemical laboratories or manufacturing, fires may routinely occur. Replacement of the glass parts each time an alarm occurs is time consuming and expensive.

Another problem with signaling devices is interference by foreign objects with operation of the switch. For example, one prior device leaves the switch exposed on all sides. This exposure permits particles from manufacturing and other foreign matter to interfere with operation of the switch. Unless there are routine tests of the alarm device, these particles may prevent operation of the device.

This invention solves these and other problems. Applicant has developed a signal box having no glass parts. When the door cover is closed, a stud mounted on the cover prevents activation of the alarm switch. In this closed position a sliding panel retains a spring-loaded activator in a depressed non-alarm position. The interaction of the sliding panel and the stud on the cover provides foolproof interlocking since opening the cover does not operate the activator. This foolproof interlock results in a two step operation, as discussed later, in order to put the signal box in an alarm condition. Because the cover is made of non-breakable material, the chance of inadvertent or accidental activation is minimized. The door cover is also solid on all sides to prevent interference from foreign material.

Two steps are required to activate applicant's alarm switch, a further assurance against inadvertent activation. First, the door cover must be pivoted to an open position. This step removes the stud from the sliding panel, but does not activate the switch. Second, a pull ring, attached to the end of the sliding panel, is used to pull the sliding panel down to a signaling position. In this position the spring-loaded activator is released into an opening in the sliding panel allowing a switch to operate.

The resetting of the signal box is very simple and does not require the replacement of any parts. First, the activator is held in the depressed position by finger pressure. The sliding panel is then returned to its normal position in which the activator is retained in the depressed position. The door cover can then be closed so that the stud is inserted in an opening in the sliding panel and prevents the sliding panel from moving downward.

These and other objects and advantages will be apparent from the drawings and descriptions as follows.

DETAILED DESCRIPTION OF THE PREFERRED EMBODIMENT

Figure 1:
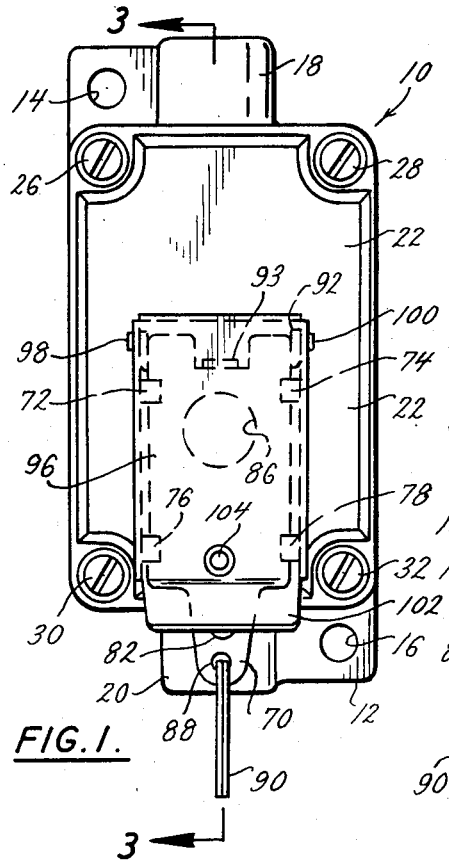
FIG. 1 is a front elevation view of the signaling box with the door of the device closed.
Figure 2:
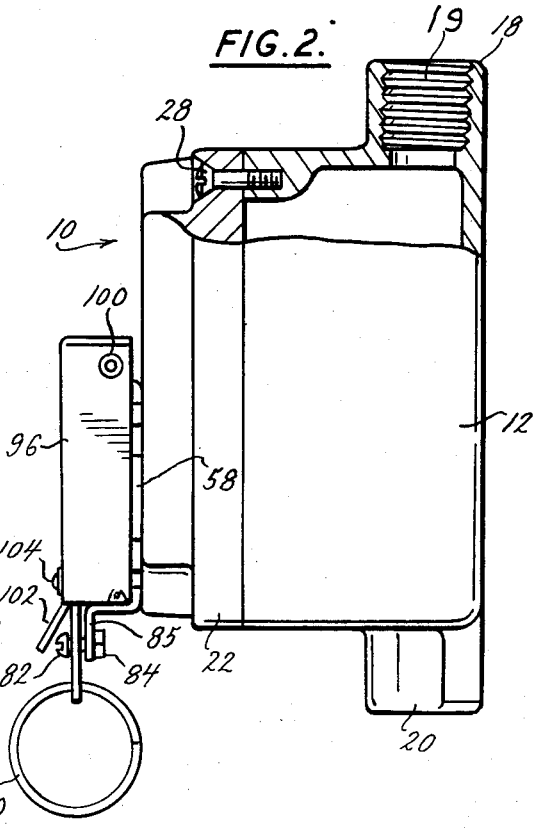
FIG. 2 is a side elevational view of the signaling box with a top portion cut away.

The remote signaling box 10, as shown in FIGS. 1 and 2, consists of a generally box-shaped base 12 and is mounted to a wall by screws (not shown) in mounting holes 14 and 16. Conduit hubs 18 and 20 on base 12 each have a female thread 19 which is suitable for threaded conduit (not shown). A cover plate 22 is attached to base 12 by screws 26, 28, 30 and 32.

A strap 34 is secured to lips 36 and 38 of base 12 by threaded screws 40 and 42. A spring-loaded switch 44 is secured to strap 34 by screws 46 and 48. Switch 44 has screw terminals 50 and 52 for termination of the signal wires (not shown) which pass through the conduit hubs 18 or 20.

The threaded bushing 54 passes through a lock-washer 55 and secures a mounting bracket 58 to cover plate 22 in the threaded bore 56. A plunger 60 is slideably engaged in bushing 54. Compression spring 62 biases the plunger 60 away from the cover plate 22 by acting between lock washer 55 and a head 64 on plunger 60.

Figure 7:
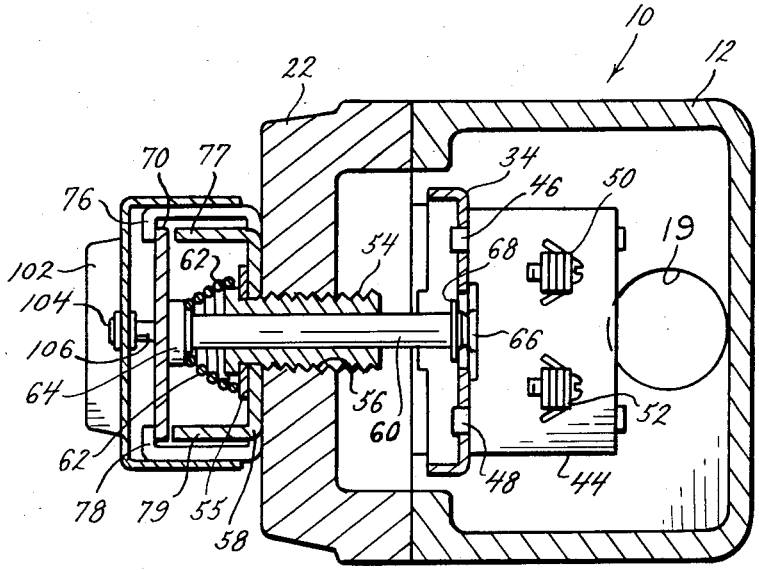
FIG. 7 is a cross-sectional view along the plane of 1 in 7—7 of FIG. 3.
Figures 3, 4, 5, 6:
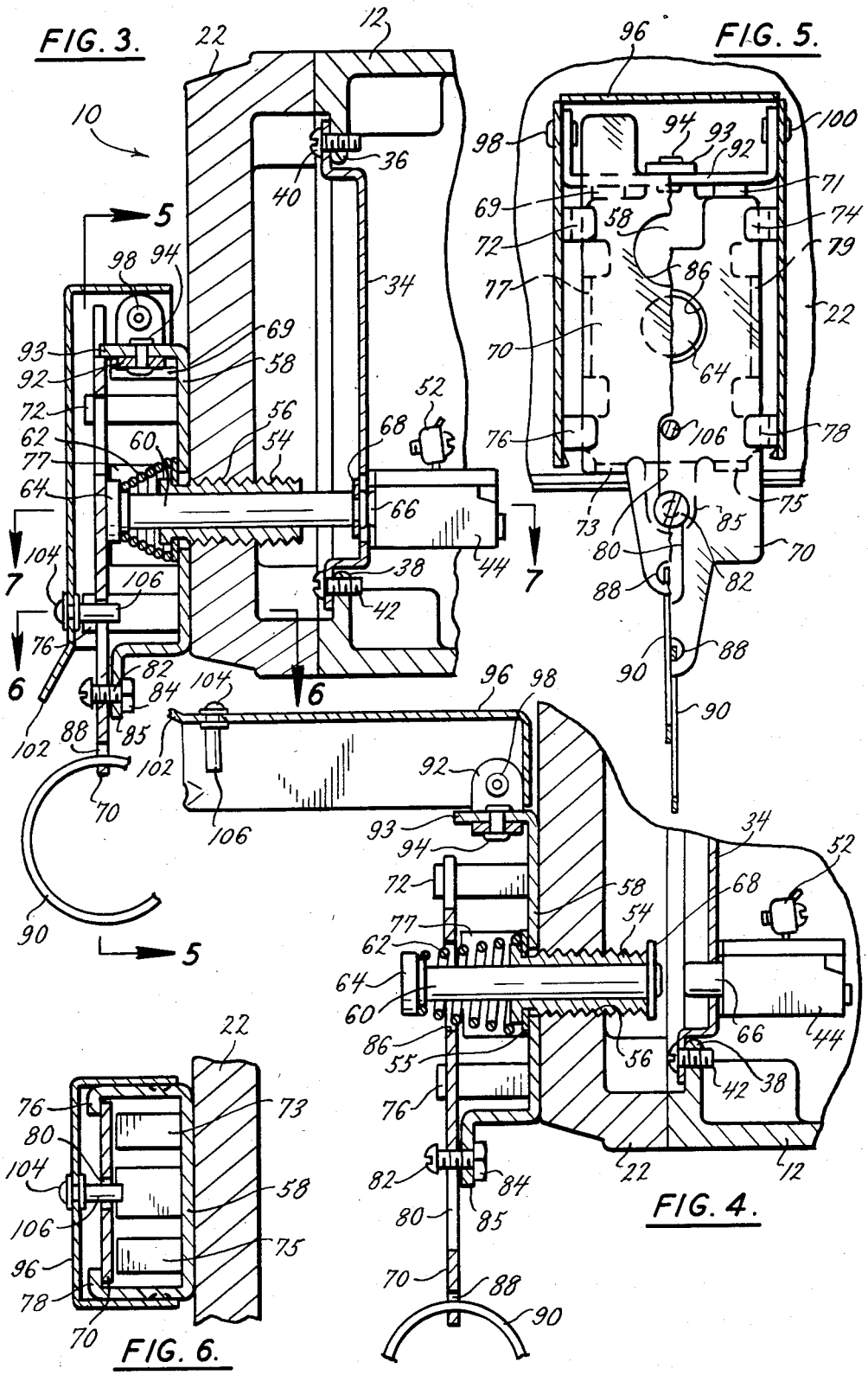
FIG. 3 is a cross-section along the plane of line 3—3 in FIG. 1 with the door in a closed position.
FIG. 4 is a cross-section similar to FIG. 3 showing the door in an open position and the switch in a released condition.
FIG. 5 is a view along the plane of line 5—5 in FIG. 3, the left half of the drawing showing the sliding panel in a closed position and the right half showing the sliding panel in a activated position.
FIG. 6 is a cross-sectional view along the plane of line 6—6 of FIG. 3.

Plunger 60 slides in bushing 54 between two positions. In a depressed position, as shown in FIG. 7, the plunger 60 pushes against the spring-loaded push button 66 of the switch 44. In a released position, as shown in FIG. 4, spring 62 biases the plunger 60 to an outward position, thus releasing the push button 66. The plunger 60 is constrained by a retaining ring 68 on plunger 60, at an end opposite to head 64, pressing against sleeve 54.

Panel 70 is slideably engaged in mounting bracket 58 and constrained so that it will move only in the vertical direction, as shown in FIG. 5. The panel 70 is supported by horizontal supports 69, 71, 73 and 75 along with vertical supports 77 and 79. These supports are all part of mounting bracket 58 and support the side of the panel 70 closest to the cover plate 22. The other side of panel 70 is constrained by four tabs 72, 74, 76 and 78 on mounting bracket 58.

Panel 70 has an enlongated opening 80, through which passes threaded machine screw 82, secured by nut 84. It will be appreciated that other fasteners or extensions equivalent to machine screw 82 may be used. Threaded screw 82 also passes through a lip 85 on bracket 58 and acts as a retainer for panel 70. Sliding panel 70 has another opening 86. When the panel 70 is in the closed position, as shown in the left half of FIG. 5, the panel 70 presses against head 64 to keep the plunger 60 in the depressed position. When the panel 70 is lowered to the activated position as shown in the right half of FIG. 5, the spring 62 biases the head 64 of plunger 60 into the opening 86. The opening is located and sized so that the head 64 is easily accommodated in opening 86 when the panel 70 is lowered. Panel 70 has a bore 88 near the bottom which accommodates a pull ring 90.

A U-shaped door bracket 92 is attached to bracket support 93 on mounting bracket 58 by rivet 94. A door 96 is mounted to door bracket 92 by rivets 98 and 100 so that the door 96 will pivot between a closed position, as shown in FIG. 3, and an open position, as shown in FIG. 4. Door 96 has an outwardly bent lip 102 used to move the door from a closed to an open position. A rivet 104 secures a cylindrically shaped stud 106 to the door 96. Stud 106 is positioned on the door 96 so that when the sliding panel 70 is in a raised position, as shown in the left half of FIG. 5, stud 106 may be inserted in the uppermost portion of elongated opening 80 by closing door 96.

OPERATION OF THE DEVICE

When the box 10 is in a non-alarm (normal) condition, the door 96 is in the closed position. The stud 106 is inserted in the elongated opening 80, preventing the sliding panel from moving downward. Thus, any downward pulling on pull ring 90 will not move the sliding panel 70.

In order to put the box 10 in an activated or signaling condition, two steps are required. These steps may be printed on the door 96 as instructions. The first step is to put the door 96 in an open position. The door may be easily lifted by grabbing the lip 102 between a thumb and a forefinger and raising the door. When the door is in the open position, stud 106 is removed from the elongated opening 80. Opening the door will not put the box in an activated condition. The second step is to move the sliding panel 70 downward by pulling on the pull ring 90. The sliding panel 70 may be pulled downward to a point where the top of elongated opening 80 pushes against machine screw 82. The head 64 of plunger 60 can now move into the opening 86. When plunger head 64 moves through opening 86 the plunger 60 no longer depresses the push button operator 66 and the switch 44 moves to an activated or alarm condition. Switch 44 can be a normally open or closed contact so that the activated condition may be adapted to any alarm system. The box, in an alarm or signaling condition, is shown in FIG. 4.

Resetting the box 10 to a non-alarm condition is very simple. First, the plunger 60 is depressed by pushing on head 64 until head 64 is beneath the surface of panel 70. Sliding panel 70 can then be moved upward. When moved sufficiently upward, the panel 70 will keep the plunger 60 depressed which in turn keeps the push button 66 in its normal position.

To finish the resetting, the panel 70 must be moved upward until the lower portion of elongated opening 80 pushes against machine screw 82. In this position the door 96 may be closed with stud 106 inserted into the upper portion of opening 80. The box 10 is now returned to its normal position, and is ready to be put into another alarm condition.

There are various changes and modifications which may be made to applicant's invention as would be apparent to those skilled in the art. However, any of these changes or modifications are included in the teaching of applicant's disclosure and applicant intends that his invention be limited only by the scope of the claims appended hereto.

I claim:

1. A remote control assembly for a signaling box of the kind defined by an enclosure including a cover plate and having a switch located within the enclosure and operable by a spring-loaded push button mounted on the switch, comprising:

a door, means for mounting the door on the cover plate for pivotal movement of the door between a closed position and an open position, means for preventing operation of the switch, said means being affixed to the door so that when the door is closed, the switch is prevented from operating and when the door is open, the switch can be operated, and means for remote activation of the spring-loaded push button comprising a plunger, means to mount the plunger so that it extends through the cover plate in alignment with the push button and is slidable between first and second positions, whereby the plunger depresses the push button in the first position of the plunger and releases the push button in the second position of the plunger, the means for preventing operation of the switch comprising a barrier for blocking movement of the plunger to the second position when the door is closed.

2. The remote control assembly of claim 1 wherein the door has a front and side walls shaped so that the door will deter foreign objects from interfering with the operation of the switch.

3. The remote control assembly of claim 1 wherein the door is fabricated of material resistant to breaking.

4. The remote control assembly of claim 1 wherein the means for preventing the operation of the switch is made of metal.

5. A remote control assembly for a signaling box having a switch activator comprising:

a bracket adapted to be mounted on the signaling box, a panel with an opening and being slideably engaged in the bracket so that when the panel is in a normal position, the switch activator is in a deactivated condition and when the panel is in an alarm position, the switch activator moves into the opening so that the switch goes to an activated condition, a door, a second opening in the panel, means for pivoting the door on the bracket from a closed position to an open position, a stud mounted on the door for preventing the sliding of the panel so that when the door is closed the stud projects into the second opening to prevent the panel from going to the alarm position and when the door is open the stud is withdrawn from the opening permitting the panel to slide to the alarm position, the second opening being displaced from the path of the stud when the panel is in the alarm position whereby the stud contacts the panel in the alarm position and prevents pivoting the door to the closed position until the panel is returned to the normal position.

6. The remote control assembly of claim 5 a door shaped so that the door will deter foreign objects from interferring with the operation of the switch.

7. The remote control assembly of claim 5 wherein the switch activator is spring-loaded, so that when the panel is in the normal position, the switch activator is depressed by the panel, and when the panel is in the alarm position the switch activator is released into the opening.

8. A signaling box comprising:

a mounting bracket;

a sliding panel with a first opening and a second opening;

a means for mounting the sliding panel on the bracket for movement of the panel from a normal position to a signaling position;

an electrical switch having push button means movable between a depressed position in which the switch is deactivated and an extended position in which the switch is activated to an alarm condition, the switch incorporating a spring normally biasing the push button means to the extended position, means to mount the switch on the box with the push button means in the path of the sliding panel when the push button means is in the extended position and with the push button means out of the path of the sliding panel when the push button is in the depressed position, the first opening being in the path of the push button means when the panel is in the signaling position and being displaced from the push button means when the panel is in the normal position so that when the sliding panel is in the normal position the push button means is in the depressed position against the force of the spring and when the sliding panel moves to the signaling position the push button means is released to be spring biased into the first opening in the sliding panel;

means for permitting manual sliding of the panel from the normal position to the signaling position;

a retaining means to constrain the sliding panel in the bracket for sliding movement between the normal and signaling positions and, a door mounted on the bracket, the door having means to pivot between an open position and a closed position, the door having a stud mounted thereon so that when the door is closed the stud is inserted in the second opening in the sliding panel when the sliding panel is in the normal position, the stud preventing the sliding panel from going to the signaling position when the door is closed and when the door is in the open position, the stud being retracted from the second opening, permitting the sliding panel to move freely to the signaling position.

9. The signaling box of claim 8, wherein the sliding panel has an opening at one end of the panel and wherein a pull ring is inserted into said opening so that the panel may be moved from the normal position to the signaling position by pulling on the pull ring.

10. The signaling box of claim 8 wherein said means for mounting the sliding panel consists of clips mounted so that the sliding panel is constrained so that it will slide in a vertical direction only.

11. The signaling box of claim 8 wherein the door is shaped so that when closed the door will deter foreign objects from interfering with the operation of the switch and when open the door will allow access to the front and sides of the sliding panel.

12. The signaling box of claim 8 further comprising a stop to prevent the sliding panel from being removed from the signal box.

13. The signaling box of claim 8 wherein the stud is blocked by the sliding panel from allowing the door to close when the sliding panel is in the signaling position.

14. The signaling box of claim 8 wherein the push button means comprises a plunger and a push button on the switch, and wherein said plunger when depressed is pressed against the push button.

15. A remote control assembly for a signaling box wherein the signaling box comprises an enclosure for an electrical switch and the enclosure includes a cover plate having an inner face within the enclosure and an outer face external of the enclosure, the switch having a member that is depressable to a depressed position to open the switch and that is biased to an extended position to close the switch, the remote control assembly comprising an activator, means for mounting the activator through the cover plate for sliding movement relative to the cover plate, the activator having a first end within the enclosure for depressing the switch member in a first position of the activator and for releasing the switch member when the activator is in a second position, the activator having a second end external of the enclosure, a signaling member movably supported by the cover plate external of the enclosure, the signaling member normally being positioned to hold the activator in the first position and being manually movable to release the activator for movement to the second position, a door movably supported by the cover plate between a normally closed position and an open position, means on the door for blocking movement of the signaling member against movement away from its normal position when the door is in its normally closed position and for unblocking movement of the signaling member when the door is moved to its open position.

16. The remote control assembly of claim 15 including a bushing mounted on and extending through the cover plate, the activator being slidable within the bushing, a head on the activator external of the enclosure, and a compression spring mounted between the head and the outer face of the cover plate for biasing the activator toward the second position.

17. The remote control assembly of claim 15 wherein the signaling member and the door are supported on the means for mounting the activator.

18. The remote control assembly of claim 17 wherein the means for mounting the actuator comprises a bushing threaded through the cover plate, a head on the bushing, a bracket clamped between the bushing head and the outer face of the cover plate, means on the bracket to support the signaling member and means on the bracket to pivotally mount the door.

19. The remote control assembly of claim 18 wherein the signaling member comprises a plate slidable relative to the bracket between the first position and the second position.

20. The remote control assembly of claim 19 wherein the means on the door comprises a projection in the path of movement of the plate when the door is in the closed position.

* * * * *